United States Patent [19]

Samelian

[11] Patent Number: 4,615,049

[45] Date of Patent: Oct. 7, 1986

[54] EASY ACCESS HAND COVERING

[76] Inventor: John K. Samelian, 751 Keokuk, Mendota Heights, Minn. 55120

[21] Appl. No.: 818,093

[22] Filed: Jan. 10, 1986

[51] Int. Cl.[4] ..... A41D 19/00

[52] U.S. Cl. ..... 2/163

[58] Field of Search ..... 2/163, 158, 159, 161 R, 2/161 A, 160

[56] References Cited

U.S. PATENT DOCUMENTS 2,327,836 8/1943 Willard ..... 2/159

3,111,676 11/1963 Slimovitz ..... 2/163

*Primary Examiner*—Doris L. Troutman

*Attorney, Agent, or Firm*—Merchant, Gould, Smith, Edell, Welter & Schmidt

[57] ABSTRACT

A hand covering (10) for protecting a hand is disclosed. The hand covering (10) includes a hollow flexible body member (11) having a front portion (12) and back portion (13). Four finger stalls (14*a–d*) having access openings (14*e–h*) are cooperatively connected to the body member (11) as is a thumb stall (15) having an access opening (15*a*). A flap portion (16) provides a means for releasably removing a substantial portion of the back portion (13), wherein a closable auxiliary opening is defined which, when said removing means is in an open position, the auxiliary opening extends from the main opening and extends proximate to the knuckles and also exposes the thumb access opening.

10 Claims, 6 Drawing Figures

EASY ACCESS HAND COVERING

BACKGROUND OF THE INVENTION

1. Field of the Invention

This invention relates generally to hand coverings, and more specifically to hand coverings, such as gloves or mittens, which provide for easy access as the wearer of the hand covering is slipping his hand into the hand covering.

2. Description of the Prior Art

For an able-bodied person, the insertion of ones hand into a hand covering, such as a glove or mitten, is a relatively simple task. However, for other segments of the population, including some older persons, persons with arthritis of hand and wrist joints, persons with hand burns or other medical conditions resulting in highly sensitive skin, the pre-school age child, the mentally handicapped and the physically handicapped, such as victims of Cerebral Palsy, the insertion of ones fingers and hand into a glove or mitten may not be an easy or even, in some circumstances, a possible task with gloves or mittens of ordinary construction or of any of the construction indicated in the prior art discussed below.

It is very difficult for such persons, or the person taking care of such persons, to insert their hand and fingers into the appropriate openings in the hand covering. The insertion of ones five fingers into the appropriate openings in a glove is quite difficult and requires a certain degree of finger and thumb dexterity, motor control, and spatial awareness. To a lesser extent, the insertion of four fingers into the large opening of a mitten and the thumb into the thumb opening of a mitten is likewise difficult. It is simply a difficult task for the primary caretaker to accomplish this function. For the purposes of this application, the term primary caretaker will refer to either the person who is trying to insert another persons hand into the hand covering, such as a young child, or to a person, such as one having arthritis, trying to insert his own hand into the hand covering.

One of the disadvantages of the prior art hand coverings is that they do not fully expose the openings proximate the fingers of the hand covering for allowing easy insertion of the hand into the hand covering. Certain athletic gloves, such as that disclosed in U.S. Pat. No. 2,270,363 provide for a cut-out exposing the back of the wearer's hand. However, such athletic gloves, in form, function, purpose and operation are not suitable for providing a hand covering that encloses and protects the entire hand.

The present invention addresses the problems associated with the prior art devices and provides for a new and improved easy access hand covering. The present invention fulfills a new purpose in glove and mitten design which is to allow for self or caretaker to easily cover a complete hand for protection, under conditions where the designs of all the prior art would not allow such an accomplishment. Such an easy access feature may also contribute an instructional function of teaching the required motor dexterity and allow for greater independence after exposure to this device.

SUMMARY OF THE INVENTION

The present invention is a hand covering for protecting a hand, including fingers, knuckles and a thumb. The hand covering includes a hollow flexible body member having front and back portions, top and bottom ends and first and second sides. The bottom end defines a main opening through which the hand is inserted and removed. A finger portion is cooperatively connected to the top end of the body member. The finger portion defines an access opening for receiving the fingers as they are inserted through the hollow body member. A thumb portion is cooperatively connected to the body member also. The thumb portion defines an access opening for receiving the thumb as it is inserted through the hollow body member. Also provided is a means for releasably removing a substantial portion of the back portion, wherein a closeable auxiliary opening is defined when the removing means is in an open position. The auxiliary opening extends from the main opening and extends proximate to the knuckles. The auxiliary opening also exposes the thumb access opening. The hand covering can take the form of various hand coverings including a glove or mitten.

In one embodiment, the removing means comprises a flap portion which, when closed, comprises a portion of the back portion. The flap portion is releasably connected to the back portion along the sides and extends from the main opening to proximate the knuckles.

In a second embodiment, the removing means comprises a flap portion, which, when closed comprises a portion of said back portion. The flap is releasably connected to the back portion along one of the sides extending from the main opening to proximate the knuckles and across the top end of the back portion proximate the knuckles.

DETAILED DESCRIPTION OF A PREFERRED EMBODIMENT

Figure 1:
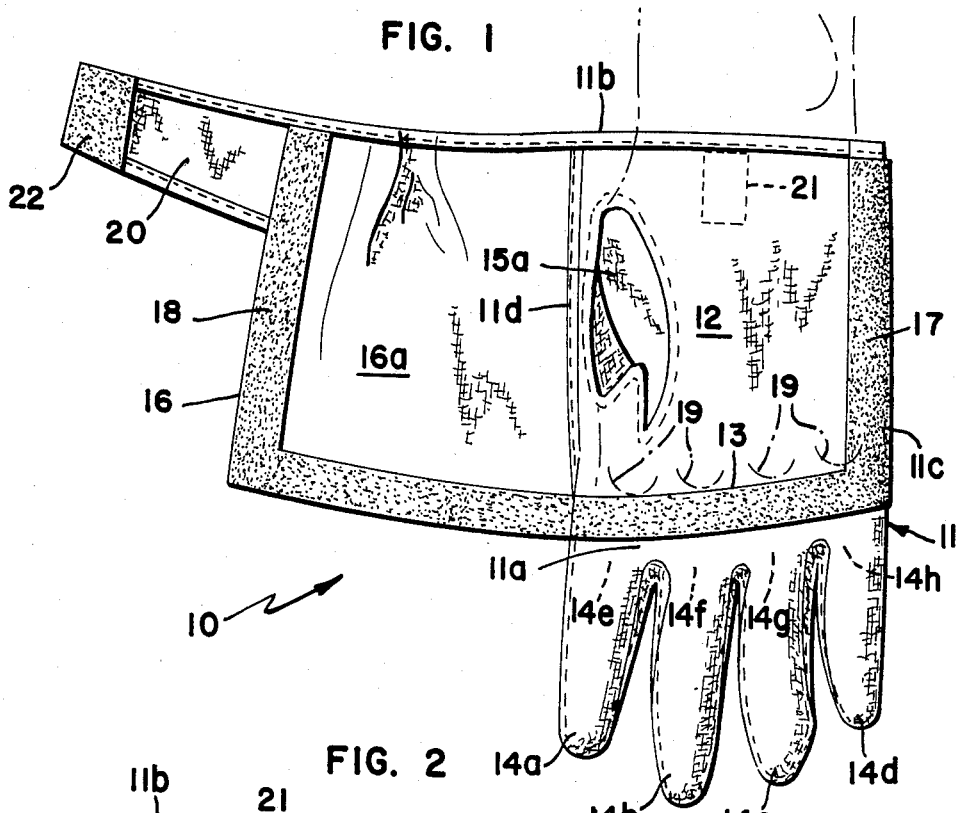
FIG. 1 is a bottom plan view of the hand covering, in an open position embodying the present invention.
Figure 2:
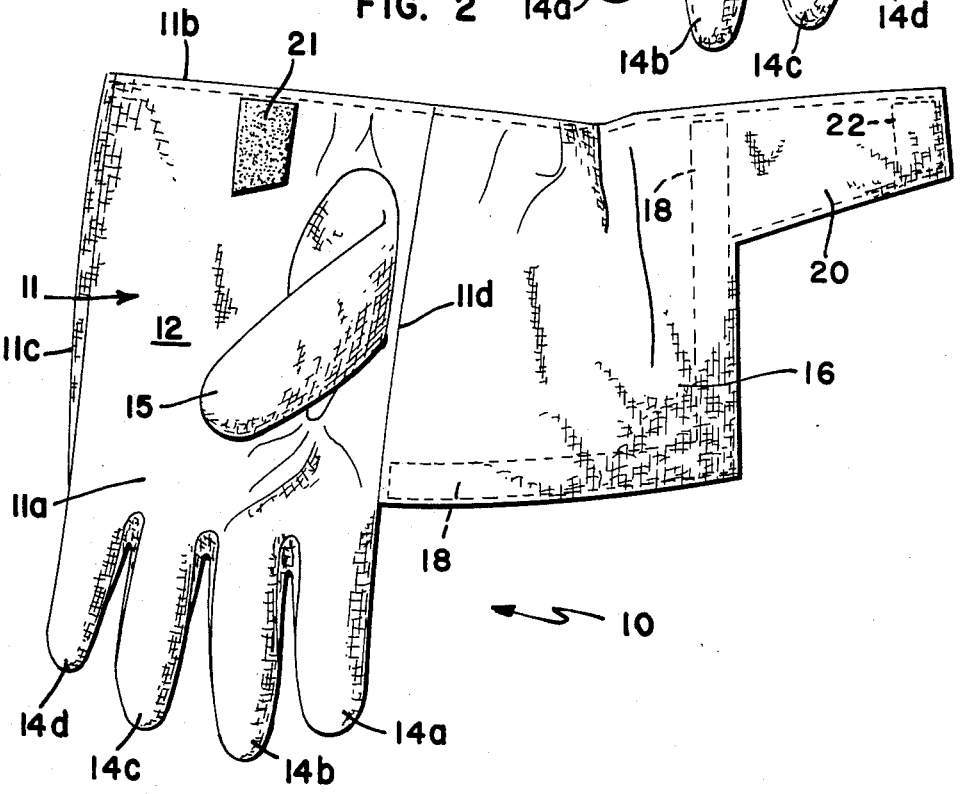
FIG. 2 is a top plan view of the hand covering, in an open position, of FIG. 1.

Referring to the drawings, wherein like numerals represent like parts throughout the several views, there is generally designated at 10 a hand covering. The hand covering 10 includes a hollow flexible body member, generally designated as 11, which comprises a front portion 12 and a back portion 13. The body member 11 has a top end 11*a* and a bottom end 11*b*. The body member 11 also has a first side 11*c* and a second side 11*d* the body member 11 defines a main opening through which the hand is inserted. A plurality of finger stalls 14*a*, 14*b*, 14*c* and 14*d* are cooperatively connected to the top end 11*a* of the body member 11, by methods well known in the art. In FIG. 1, the dashed line surrounding the finger stalls 14*a–d* represent the inside edge of the fabric that is used to make the finger stalls. Each of the finger stalls 14*a–d* define access openings 14*e* through *h*, respectively, through which the wearer's fingers may be inserted and removed.

A thumb stall 15 is cooperatively connected to the front portion 12 between the top end 11*a* and bottom end 11*b*, by methods well known in the art. The thumb stall 15 defines an access opening 15*a* through which the thumb of the wearer may be inserted and removed while putting the hand covering 10 on and off the wearer's hand.

In the embodiment shown in the FIGS. 1 through 4, the back portion 13 includes a means for releasably removing a substantial portion of the back portion 13. In the embodiment as shown in FIGS. 1 through 4, the removing means comprises a releasable flap portion 16. Any suitable means of releasably fastening the flap portion 16 may be used, such as a velcro fastner. As shown in FIG. 1, the hook portion 17 of a velcro fastner is cooperatively connected to the back portion 13 along the side 11*c* and extends from proximate the bottom end 11*b* to a position proximate where the wearer's knuckles 19 would be located and then across the width of the back portion 13, again positioned proximate over the wearer's knuckles to the second side 11*b*. On the bottom side 16*a* of flap portion 16 the pile portion 18 of the velcro fastner is cooperatively connected and positioned such that when closed, overlays the hook portion 17. Cooperatively connected to the back portion 13 is a cinch strap 20. The cinch strap 20 forms an extension of the back portion 13 extending along the bottom end 11*b*. A hook portion 21 of a velcro type fastener is attached to the front portion 12 proximate the bottom end 11*b*. A mating pile portion 22 is cooperatively connected at the end of the cinch strap 20.

Figure 5:
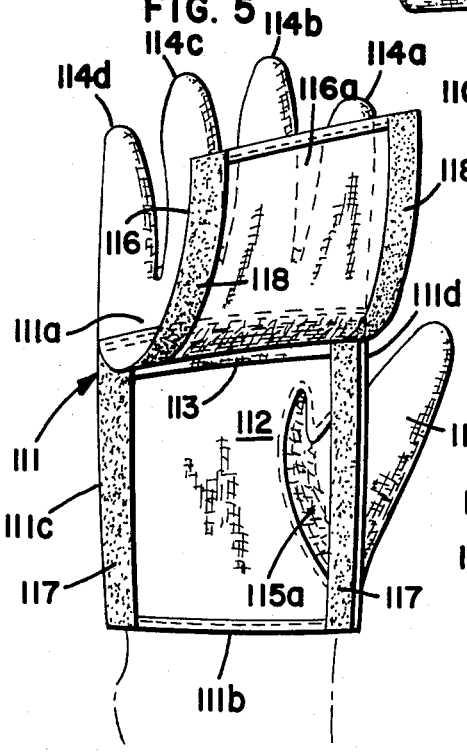
FIG. 5 is a bottom plan view, in an open portion, of a second embodiment of a hand covering embodying the present invention.
Figure 6:
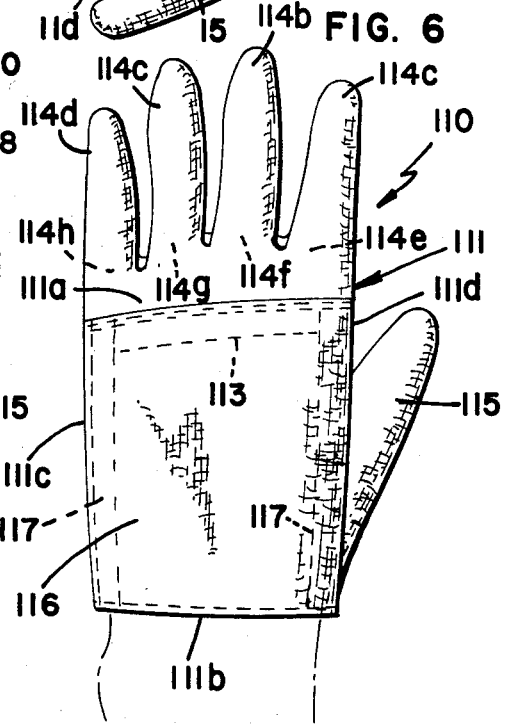
FIG. 6 is a bottom plan view, in a closed position, of the embodiment of FIG. 3.

The first embodiment of the present invention, shown in FIGS. 1 through 4, illustrates a hand covering that is a glove. A second embodiment of the present invention is shown in FIGS. 5 and 6 and similarly is a hand covering in the configuration of a glove. It is of course understood that both embodiments could be easily adapted to take on the configuration of a mitten as opposed to a glove and still have all of the advantages of the present invention.

The second embodiment of the present invention, as shown in FIGS. 5 and 6, generally illustrates a hand covering 110. Except for the construction of the means for releasably removing a portion of the back portion, the construction of the hand covering 110 is similar to the construction of the hand covering 10. The hand covering 110 includes a hollow flexible body member, generally designated as 111, which comprises a front portion 112 and a back portion 113. The body member 111 has a top end 111*a* and a bottom end 111*b*. The body member 111 also has a first side 111*c* and a second side 111*d*. A plurality of finger stalls 114*a*, 114*b*, 114*c* and 114*d* are cooperatively connected to the top end 111*a* of the body member 111 by methods well known in the art. Each of the finger stalls 114*a–d* define access openings 114*e–h*, respectively, similar to that of hand covering 10, through which the wearer's fingers may be inserted and removed.

A thumb stall 115 is cooperatively connected to the front portion 112 between the top end 111*a* and the bottom end 111*b*, by methods well known in the art. The thumb stall 115 defines an access opening 115*a* through which the thumb of the wearer may be inserted and removed while putting the hand covering 110 on and off the wearer's hand. The back portion 113 includes a means for releasably removing a substantial portion of the back portion 113. The removing means comprises a releasable flap portion 116 any suitable means of releasably fastening the flap portion 116 may be used, such as velcro fasteners. As shown in FIGS. 5 and 6, a hook portion 117 of a velcro fastener is cooperatively connected to the back portion 113 along both the sides 111*c* and 111*d*. The hook portions 117 extend from proximate the bottom end 111*b* to a position proximate where the wearer's knuckles would be located. On the bottom side 116*a* of the flap portion 116 the pile portion 118 of the velcro fastener is cooperatively connected and positioned such that when closed, overlays the hook portions 117. While a cinch strap is not shown in FIGS. 5 and 6, it is readily understood that a suitable cinch strap may also be cooperatively connected to the flap portion 116, similar to the cinch strap in the embodiment shown in FIGS. 1 through 4.

Figure 3:
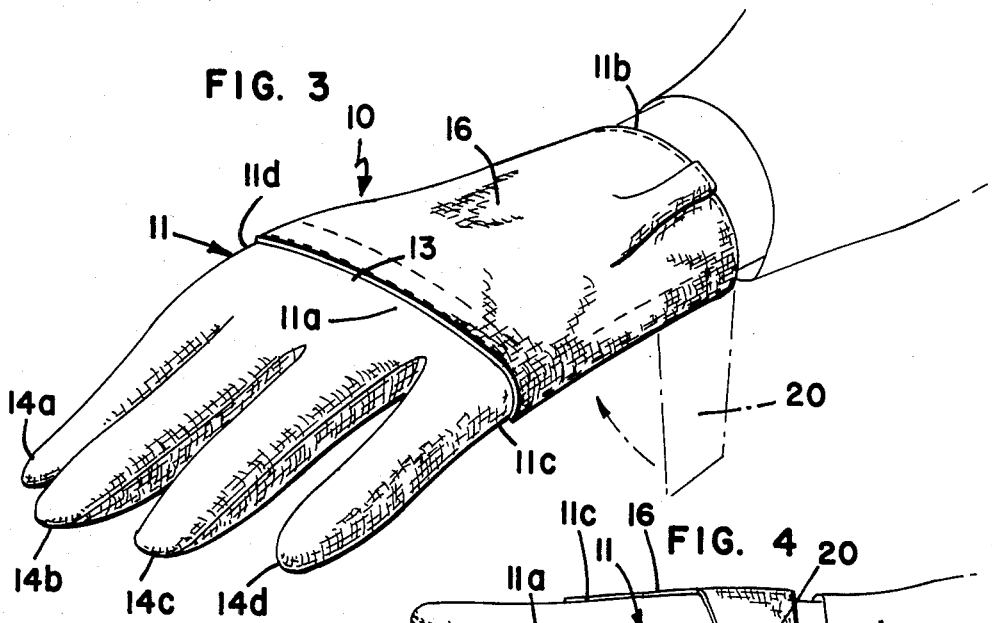
FIG. 3 is a perspective view of the hand covering of claim 1, shown on the hand of a wearer.
Figure 4:
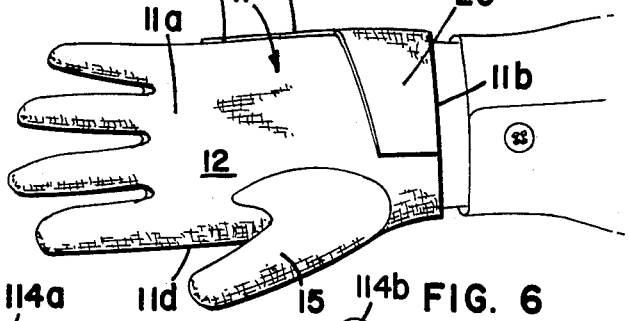
FIG. 4 is a top plan view of the hand covering of claim 1, shown on the hand of a wearer.

In operation, when the primary caretaker wishes to place the hand covering 10 on a hand, it is only necessary for the primary caretaker to unhook the cinch strap 20 by rotation in a direction opposite shown by the arrow in FIG. 3 and continue rotation in a direction opposite the arrow to release the flap portion 116 to an open position, as shown in FIG. 1. The wearer's hand is then inserted into the hand covering 110 through the main opening with the wearer's fingers going through the individual access openings 14*e–h* and 15*a*. Since the flap portion creates an enlarged auxiliary opening which includes the area where the wearer's knuckles would be located, it is easy for the primary caretaker to insert the fingers into the individual access openings 14*e–h* and 15*a*. The flap portion 16 is then brought back across the back of the wearer's hands and the pile portion 18 engages the hook portion 17 thereby completely closing and covering the back of the wearer's hand. The cinch strap then is continued in a rotation, as shown in FIG. 3 and the pile portion 22 is moved over the hook portion 21 and fastened at the appropriate place. The width of the hook portion 21 and pile portion 22 will allow for varying tightness of the cinch strap 20 around the wrist of the wearer. This will enable the hand covering 10 to stay firmly on the hand of the wearer. The flap portion 16 creates a closable opening, the opening being proximate the wearer's knuckles. It is understood that the opening created by the flap portion 16 could extend even further beyond the knuckles, closer to the finger stalls themselves.

The operation of the second embodiment is somewhat similar, in that the opening of the flap portion 116 also creates a closable auxiliary opening, whose opening extends up to proximate the knuckles of the wearer. The operation of the embodiment shown in FIGS. 5 and 6 is simply for the primary caretaker to lift up on the flap portion 116, as shown in FIG. 5, to release the flap portion 116 from the back portion 113. This then creates easy access for the fingers and thumb of the wearer into the access openings 114*e–h* and 115*a*. After the wearer's hand is in position, the flap portion 116 is simply brought downwards to a closed position, as shown in FIG. 6, with the hook portion 117 engaging the pile portion 118 to firmly enclose the hand of the wearer.

Both embodiments of the invention provide for a closable opening that makes it possible for a primary caretaker to more easily insert the wearer's hand into a glove that is capable of being closed and completely enclosing the back side of the wearer's hand to provide warmth. The specific construction of the hand coverings 10 and 110 have not been discussed in detail, as construction of gloves or mittens are well known in the art and any suitable construction may be used, as long as it incorporates the means for creating the releasable openings similar to those shown in FIGS. 1 through 6. The hand coverings may of course be lined or insulated to provide for greater warmth. Other specific construction details, such as elastic in the cinch strap or various method of stitching or cooperatively connecting the velcro fasteners to the hand covering to relieve stress may be incorporated where appropriate by methods well known in the art.

In both embodiments, the hand coverings 10 and 110 completely expose the thumb access openings 15*a* and 115*a* for easy insertion of the thumb into the thumb stall 15 and 115.

Other modifications of the invention will be apparent to those skilled in the art in light of the foregoing description. This description is intended to provide specific examples of individual embodiments which clearly disclose the present invention. Accordingly, the invention is not limited to these embodiments or the use of elements having specific configurations and shapes as presented herein. All alternative modifications and variations of the present invention which follows in the spirit and broad scope of the appended claims are included.

What is claimed is:

1. A hand covering for protecting a hand, including fingers, knuckles and a thumb, comprising:

(a) a hollow flexible body member having front portion and back portions, top and bottom ends, and a first and second sides, said bottom end defining a main opening through which the hand is inserted and removed;

(b) a finger portion cooperatively connected to said top end of said body member said finger portion defining an access opening, said access opening for receiving the fingers as they are inserted through said hollow member;

(c) a thumb portion cooperatively connected to said body member, said thumb portion defining an access opening, said access opening of said thumb portion for receiving the thumb as it is inserted through said hollow member; and (d) means for releasably removing a substantial portion of said back portion, wherein a closeable auxiliary opening is defined, which, when said removing means is in an open position, said auxiliary opening extending from said main opening and extends proximate to the knuckles and also exposing said thumb access opening.

2. The hand covering of claim 1, wherein said removing means comprises a flap portion, which, when closed comprises a portion of said back portion, said flap portion releasably connected to said back portion along said sides, extending from said main opening to proximate the knuckles.

3. The hand covering of claim 2, wherein a pile fastner provides for releasably connecting said flap portion to said back portion.

4. The hand covering of claim 1, wherein said removing means comprises a flap portion, which, when closed comprises a portion of said back portion, said flap being releasably connected to said back portion along one of said sides extending from said main opening to proximate the knuckles and across said top end of said back portion proximate said knuckles.

5. The hand covering of claim 4, wherein a pile fastner provides for releasably connecting said flap portion of said back portion.

6. The hand covering of claim 1, wherein said finger portion comprises four finger stalls.

7. The hand covering of claim 1, wherein said thumb portion is cooperatively connected to said front section and is intermediate said top end and said bottom end.

8. The hand covering of claim 1, further comprising a wrist strap member having a first end cooperatively connected to said back portion and a second end cooperatively connected to said front portion, one of said ends being releasably connected to one of said portions.

9. A hand covering for protecting a hand, including fingers, knuckles and a thumb, comprising:

(a) a hollow flexible body member having front portion and back portions, top and bottom ends, and a first and second sides, said bottom end defining a main opening through which the hand is inserted and removed;

(b) a finger portion cooperatively connected to said top end of said body member said finger portion having four finger stalls, each of said stalls defining an access opening, said access openings for receiving the fingers as they are inserted through said hollow member;

(c) a thumb portion cooperatively connected to said first section of said body member intermediate said top end and said bottom end, said thumb portion defining an access opening, said access opening of said thumb portion for receiving the thumb as it is inserted through said hollow member;

(d) means for releasably removing a substantial portion of said back portion, said removing means comprises a flap portion, which, when closed comprises a portion of said back portion, said flap portion releasably connected to said back portion along said sides, extending from said main opening to proximate the knuckles, wherein a closable auxiliary opening is defined, which, when said removing means is in an open position, said auxiliary opening also exposing said thumb access opening wherein a pile fastener provides for releasably connecting said flap portion to said back portion; and (e) a wrist strap member having a first end cooperatively connected to said back portion and a second end cooperatively connected to said front portion, one of said ends being releasably connected to one of said portions.

10. A hand covering for protecting a hand, including fingers, knuckles and a thumb, comprising:

(a) a hollow flexible body member having front portion and back portions, top and bottom ends, and a first and second sides, said bottom end defining a main opening through which the hand is inserted and removed;

(b) a finger portion cooperatively connected to said top end of said body member said finger portion defining an access opening, said access opening for receiving the fingers as they are inserted through said hollow member;

(c) a thumb portion cooperatively connected to said first section of said body member intermediate said top end and said bottom end, said thumb portion defining an access opening, said access opening of said thumb portion for receiving the thumb as it is inserted through said hollow member; and (d) means for releasably removing a substantial portion of said back portion, said removing means comprises a flap portion, which, when closed comprises a portion of said back portion, said flap portion releasably connected to said back portion along said sides, extending from said main opening to proximate the knuckles, wherein a closable auxiliary opening is defined when said removing means is in an open position, said auxiliary opening also exposing said thumb access opening wherein a pile fastener provides for releasably connecting said flap portion to said back portion.

* * * * *